US007677363B2

(12) United States Patent
Kawai

(10) Patent No.: US 7,677,363 B2
(45) Date of Patent: Mar. 16, 2010

(54) EVACUATION ASSISTANCE DEVICE FOR ELEVATOR

(75) Inventor: Kiyoji Kawai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/088,329

(22) PCT Filed: Feb. 23, 2006

(86) PCT No.: PCT/JP2006/303289

§ 371 (c)(1),
(2), (4) Date: Mar. 27, 2008

(87) PCT Pub. No.: WO2007/096969

PCT Pub. Date: Aug. 30, 2007

(65) Prior Publication Data

US 2009/0038891 A1 Feb. 12, 2009

(51) Int. Cl.
*B66B 1/18* (2006.01)

(52) U.S. Cl. ..... 187/387; 187/384; 187/392; 187/313

(58) Field of Classification Search ..... 187/247, 187/248, 313, 316, 317, 380–388, 391–393
See application file for complete search history.

(56) References Cited

U.S. PATENT DOCUMENTS 4,023,146 A * 5/1977 Carroll ..... 710/113
5,979,607 A * 11/1999 Allen ..... 187/390
6,000,505 A * 12/1999 Allen ..... 187/391
7,021,429 B2 * 4/2006 Hikita ..... 187/398
7,182,174 B2 * 2/2007 Parrini et al. ..... 182/18
7,210,564 B2 * 5/2007 Kawai ..... 187/384
7,461,723 B2 * 12/2008 Kawai ..... 187/313

FOREIGN PATENT DOCUMENTS

JP 51 23935 2/1976
JP 5 8954 1/1993

(Continued)

OTHER PUBLICATIONS

Ai Sekizawa, et al., Study on Feasibility of Evacuation using Elevators in a High-rise Building (Part 1 and Part.2), pp. 590-593 and pp. 586-589, 2004, (with partial English translation).

*Primary Examiner*—Jonathan Salata
(74) *Attorney, Agent, or Firm*—Oblon, Spivak, McClelland, Maier & Neustadt, L.L.P.

(57) ABSTRACT

A rescue floor crowdedness detecting device detects crowdedness or uncrowdedness of an elevator region at a rescue floor. An evacuation guidance device installed in a building reports to those stranded in the building accessibility information representing accessibility of those stranded in the building to the elevator region at the rescue floor from a stair region when the rescue floor crowdedness detecting device detects that the elevator region of the rescue floor is uncrowded. An emergency control device has an evacuation operation performability determining portion for determining whether or not those stranded in the building can be conveyed from the rescue floor to the evacuation floor. The emergency control device also has an evacuation guidance device control portion for controlling the evacuation guidance device based on information from the evacuation operation performability determining portion and information from the rescue floor crowdedness detecting device.

14 Claims, 12 Drawing Sheets

FOREIGN PATENT DOCUMENTS

| | | |
|---|---|---|
| JP | 8 268656 | 10/1996 |
| JP | 9 220293 | 8/1997 |
| JP | 2004 269154 | 9/2004 |
| JP | 2005 104631 | 4/2005 |
| WO | WO 99/50165 | 10/1999 |

* cited by examiner

EVACUATION ASSISTANCE DEVICE FOR ELEVATOR

TECHNICAL FIELD

The present invention relates to an evacuation assistance device for an elevator for evacuating those stranded in a building in an event of a fire in the building.

BACKGROUND ART

Conventionally, there is proposed an operation system for elevators in which control operation for stopping cars at nearest floors is performed individually for a plurality of elevator groups in the event of a fire in a building in which the elevator groups are installed. The orders of priority for starting control operation are set for the elevator groups based on a fire occurrence floor. Control operation is started in the elevator groups in the order of priorities thus set. Thus, the duration of normal operation in those of the elevator groups which are not seriously affected by the fire can be extended (see Patent Document 1).

Patent Document 1: JP 05-8954 A

DISCLOSURE OF THE INVENTION

Problem to be solved by the Invention

In the operation system for the elevators disclosed in Patent Document 1, however, only the duration of normal operation in one or some of the elevator groups can be extended. After the cars have been stopped through control operation, those stranded in the building cannot be conveyed to an evacuation floor. Accordingly, the efficiency in evacuating those stranded in the building in the event of a fire cannot be enhanced.

The present invention has been made to solve the above-mentioned problem, and it is therefore an object of the present invention to provide an emergency control device for an elevator which makes it possible to enhance the efficiency in evacuating those stranded in a building in the event of a fire to an evacuation floor.

Means for Solving the Problem

An evacuation assistance device for an elevator according to the present invention, in an event of a fire in a building provided with an elevator whose service floors are defined as each of a plurality of floors included in a service zone and evacuation stairs used to move upstairs and downstairs among the floors, sets a predetermined one of the service floors as a rescue floor and supervises an operation of the elevator so as to convey those stranded in the building from the rescue floor to an evacuation floor. The floors are each separated into an elevator region in which the elevator is provided and a stair region in which the evacuation stairs are provided. The evacuation assistance device includes: a rescue floor crowdedness detecting device for detecting crowdedness or uncrowdedness of the elevator region at the rescue floor; an evacuation guidance device installed in the building to report to those stranded in the building accessibility information representing accessibility of those stranded in the building to the elevator region at the rescue floor from the stair region; and an emergency control device having an evacuation operation performability determining portion for determining whether or not those stranded in the building can be conveyed from the rescue floor to the evacuation floor and an evacuation guidance device control portion for controlling the evacuation guidance device based on information from the evacuation operation performability determining portion and information from the rescue floor crowdedness detecting device.

BEST MODE FOR CARRYING OUT THE INVENTION

A preferred embodiment of the present invention will be described hereinafter with reference to the drawings.

Embodiment 1

Figure 1:
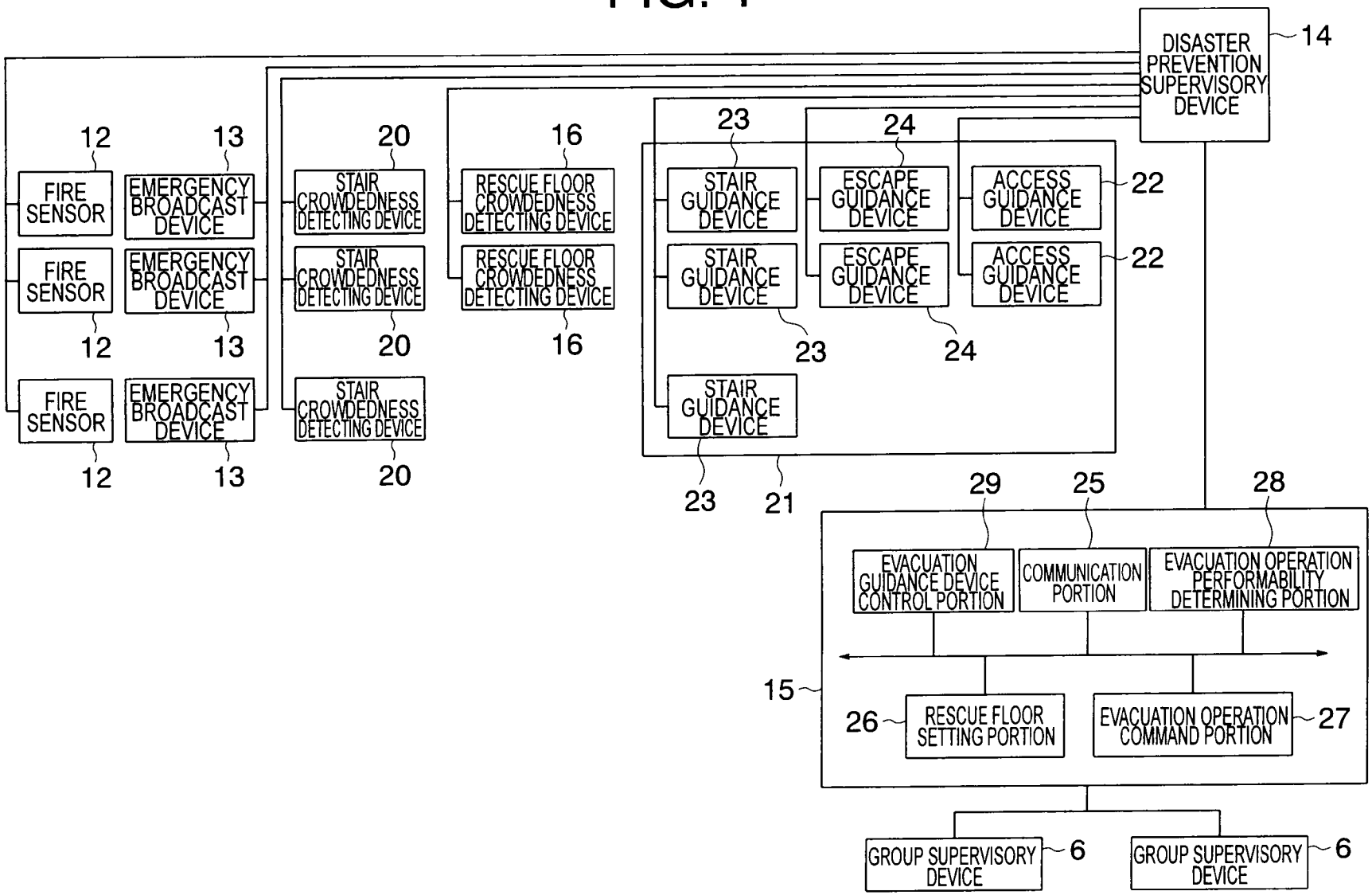
FIG. 1 is a block diagram showing an evacuation assistance device for elevators according to Embodiment 1 of the present invention.
Figure 2:
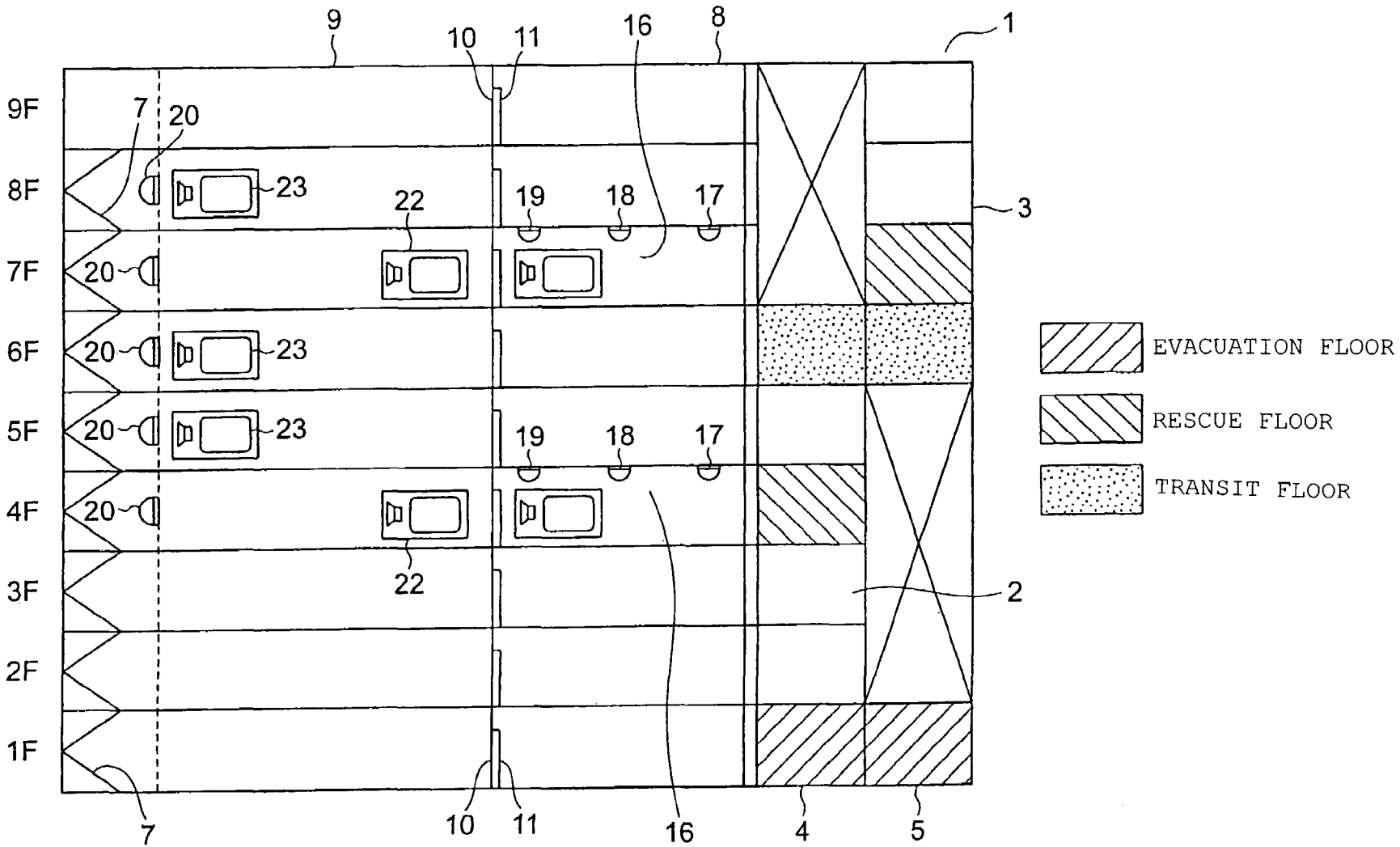
FIG. 2 is a schematic diagram showing a building in which the elevators, which are supervised and controlled by the evacuation assistance device for the elevators shown in FIG. 1, are provided.

FIG. 1 is a block diagram showing an evacuation assistance device for elevators according to Embodiment 1 of the present invention. FIG. 2 is a schematic diagram showing a building in which the elevators, which are supervised and controlled by the evacuation assistance device for the elevators shown in FIG. 1, are provided. Referring to FIGS. 1 and 2, a building (building of this example rises nine stories above the ground) 1 having a plurality of floors is provided with a low-layer service zone 2 including the respective floors ranging from the second floor to the sixth floor, and a high-layer service zone 3 including the floors ranging from the sixth floor to the ninth floor. That is, the building 1 is provided with a plurality (two in this example) of the service zones 2 and 3 each including the corresponding ones of the plurality of floors, and the floors included in the service zone 2 are at least partially different from the floors included in the service zone 3. The building 1 is also provided with a common evacuation floor included in neither the service zone 2 nor the service zone 3. In this example, the first floor, namely, the lowest floor of the building 1 is used as the evacuation floor.

In addition, the building 1 is provided with an elevator 4 on a low-layer bank whose service floors are defined as the floors (ranging from the second floor to the sixth floor) included in the low-layer service zone 2, and an elevator 5 on a high-layer bank whose service floors are defined as the floors (ranging from the sixth floor to the ninth floor) included in the high-layer service zone 3. That is, the building 1 is provided individually with the elevators 4 and 5 each having the service floors defined as the floors included in a corresponding one of the service zones 2 and 3. In this example, the sixth floor, which is included in both of the respective service zones 2 and 3, is used as a transit floor between the respective elevators 4 and 5.

Each of the elevators 4 and 5 on the respective banks has a plurality of elevator machines (not shown). The elevator machines in the elevator 4 on the low-layer bank have cars, which can be stopped at the service floors in the low-layer service zone 2 and the evacuation floor. The elevator machines in the elevator 5 on the high-layer bank have cars, which can be stopped at the service floors in the high-layer service zone 3 and the evacuation floor.

Each of the elevators 4 and 5 on the respective banks is provided with a group supervisory device 6 (FIG. 1) for supervising and controlling the operation of each of the elevator machines. That is, in each of the elevators 4 and 5, the cars are individually moved under the supervision of a corresponding one of the group supervisory devices 6.

The building 1 is also provided with evacuation stairs 7 for helping those stranded in the building 1 to move among the floors (move upstairs and downstairs). Each of the floors is separated into an elevator region 8 in which at least one of the elevators 4 and 5 is provided, and a stair region 9 in which the evacuation stairs 7 are provided. An evacuation doorway 10 through which the regions 8 and 9 communicate with each other, and a fire door 11 capable of opening/closing the evacuation doorway 10 are provided between the elevator region 8 and the stair region 9.

The floors are provided respectively with fire sensors 12 for sensing the occurrence of a fire, and emergency broadcast devices 13 for delivering a broadcast on the occurrence of the fire to the entire building 1.

Information from the fire sensors 12 is transmitted to a disaster prevention supervisory device 14 for supervising disaster prevention components in the entire building 1 comprehensively. The disaster prevention supervisory device 14 detects whether or not a fire has occurred and identifies a fire occurrence floor, based on the information from the fire sensors 12.

Information from the disaster prevention supervisory device 14 is transmitted to an emergency control device 15 for supervising the group supervisory devices 6 comprehensively in the event of a fire. After the occurrence of the fire has been detected by the disaster prevention supervisory device 14, the emergency control device 15 performs evacuation operation for conveying those stranded in the building to the evacuation floor as to each of the elevators 4 and 5. Evacuation operation is performed, as to the service zones 2 and 3, by setting predetermined ones of the service floors (the fourth floor and the seventh floor in this example) as rescue floors, respectively, and moving each of the cars back and forth between a corresponding one of the rescue floors and the evacuation floor.

The elevator region 8 of each of the rescue floors is provided with a rescue floor crowdedness detecting device 16 for detecting the crowdedness or uncrowdedness of the elevator region 8. In this example, when the elevator region 8 of each of the rescue floors is uncrowded, a degree of availability of a space in the elevator region 8 (space availability degree in the elevator region 8) can also be detected from information from the rescue floor crowdedness detecting device 16. The rescue floor crowdedness detecting device 16 has a plurality (three in this example) of strander detector detectors 17 to 19 disposed apart from one another between a corresponding one of the elevators 4 and 5 and the evacuation doorway 10. In this example, the strander detector detectors 17 to 19 are designed as photographing devices (cameras) capable of photographing different detection ranges (rescue floor detection ranges) in the elevator region 8.

The crowdedness or uncrowdedness of the elevator region 8 is detected by comparing occupancy ratios of those stranded in the building 1 in the rescue floor detection ranges with a preset threshold. That is, when all the occupancy ratios of those stranded in the building in the rescue floor detection ranges are larger than the threshold, the crowdedness of the elevator region 8 is detected. When at least one of the occupancy ratios of those stranded in the building in the rescue floor detection ranges is equal to or smaller than the threshold, the uncrowdedness of the elevator region 8 is detected. The occupancy ratios of those stranded in the building in the rescue floor detection ranges can be calculated by subjecting information from the strander detector detectors 17 to 19 to an image processing.

The space availability degree in the elevator region 8 is detected by calculating the number of those rescue floor detection ranges in which the occupancy ratio of those stranded in the building is equal to or smaller than the threshold. That is, the space availability degree in the elevator region 8 increases as the number of the rescue floor detection ranges in which the occupancy ratio of those stranded in the building is equal to or smaller than the threshold increases.

The rescue floors and the floors located above the rescue floors (the fourth to eighth floors in this example) are each provided with a stair crowdedness detecting device 20 for detecting the crowdedness or uncrowdedness of the stair region 9.

In this example, the stair crowdedness detecting device 20 is a photographing device (camera) capable of photographing a predetermined detection range of the evacuation stairs 7 (stair detection range). The crowdedness or uncrowdedness of the stair region 9 is detected by comparing the occupancy ratio of those stranded in the building in the stair detection range with a preset threshold. That is, when the occupancy ratio of those stranded in the building in the stair detection range is larger than the threshold, the crowdedness of the stair region 9 is detected. When the occupancy ratio of those stranded in the building in the stair detection range is equal to or smaller than the threshold, the uncrowdedness of the stair region 9 is detected. The occupancy ratio of those stranded in the building in the stair detection range is calculated by subjecting information from the stair crowdedness detecting device 20 to an image processing.

An evacuation guidance device 21 for guiding those stranded in the building in the event of a fire is provided in the building 1. The evacuation guidance device 21 reports to those stranded in the building evacuation information for evacuation to the evacuation floor, thereby guiding those stranded in the building.

The evacuation guidance device 21 has an access guidance device 22 for reporting to those stranded in the building accessibility information stating whether or not those stranded in the building can access the elevator region 8 of each of the rescue floors from the stair region 9, a stair guidance device 23 for reporting to those stranded in the building stair mobility information stating whether or not those stranded in the building 1 can move by the evacuation stairs 7, and an escape guidance device 24 for reporting to those stranded in the building escapability information stating whether or not those stranded in the building can escape from the elevator region 8 of each of the rescue floors to the stair region 9. The accessibility information, the stair mobility information, and the escapability information are included in the evacuation information.

The access guidance device 22 is provided at the evacuation doorway 10 in the stair region 9 at each of the rescue floors (the fourth floor and the seventh floor in this example). The stair guidance device 23 is provided in the stair region 9 at each of the floors located above the rescue floors (the fifth floor, the sixth floor, and the eighth floor in this example). In addition, the escape guidance device 24 is provided at the evacuation doorway 10 in the elevator region 8 of each of the rescue floors.

Information from the rescue floor crowdedness detecting device 16 and information from the stair crowdedness detecting device 20 are transmitted to the emergency control device 15 via the disaster prevention supervisory device 14. The emergency control device 15 controls each of the elevators 4 and 5 and the evacuation guidance device 21 based on information from the disaster prevention supervisory device 14, the information from the rescue floor crowdedness detecting device 16, and the information from the stair crowdedness detecting device 20.

The emergency control device 15 has a communication portion 25, a rescue floor setting portion 26, an evacuation operation command portion 27, an evacuation operation performability determining portion 28, and an evacuation guidance device control portion 29.

The communication portion 25 allows each of the respective group supervisory devices 6 and the disaster prevention supervisory device 14 to exchange information with the emergency control device 15.

The rescue floor setting portion 26 sets predetermined ones of the service floors as rescue floors as to the service zones 2 and 3. In this example, the rescue floor setting portion 26 sets, for each of the service zones 2 and 3, one rescue floor selected from the service floors included therein.

The rescue floors (predetermined service floors) are specified by separating the building 1 into a plurality of evacuation zones each including a plurality of floors different from the evacuation floor, and setting the lowest floors in the evacuation zones other than the lowest evacuation zone as the rescue floors (predetermined service floors). The number of the evacuation zones is larger than the number of the service zones 2 and 3 by one. That is, in the building 1 provided with elevators on N banks, the rescue floors (predetermined service floors) are specified by separating the building 1 into (N+1) evacuation zones, and then setting the lowest floors in the N evacuation zones other than the lowest evacuation zone as the predetermined service floors.

The predetermined service floor specified according to the foregoing method is stored in advance in the emergency control device 15 as the rescue floors for each of the service zones 2 and 3. In setting the rescue floors, the rescue floor setting portion 26 reads the rescue floors stored in the emergency control device 15.

Figure 3:
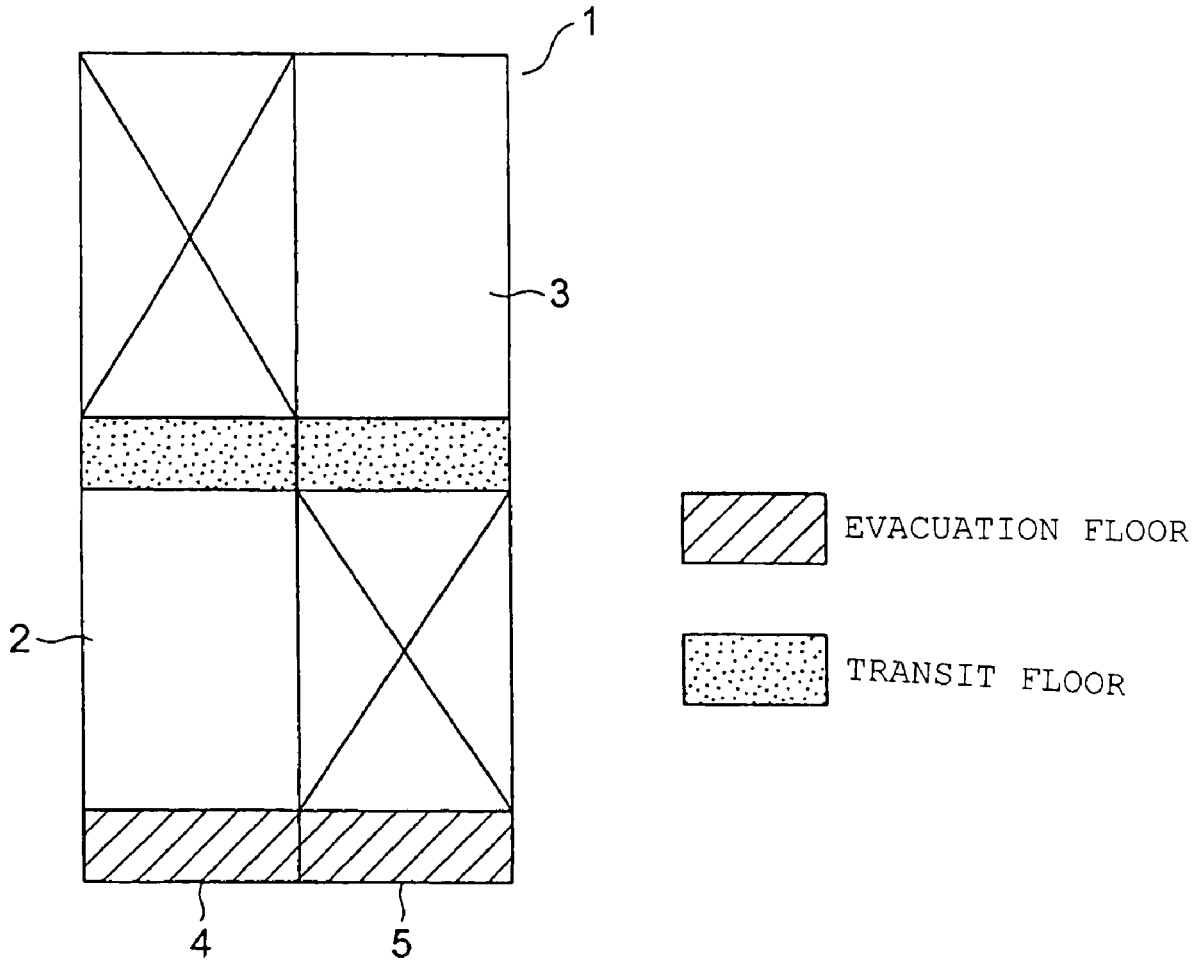
FIG. 3 is a schematic diagram showing the building before the rescue floor setting portion of FIG. 1 sets the rescue floors.
Figure 4:
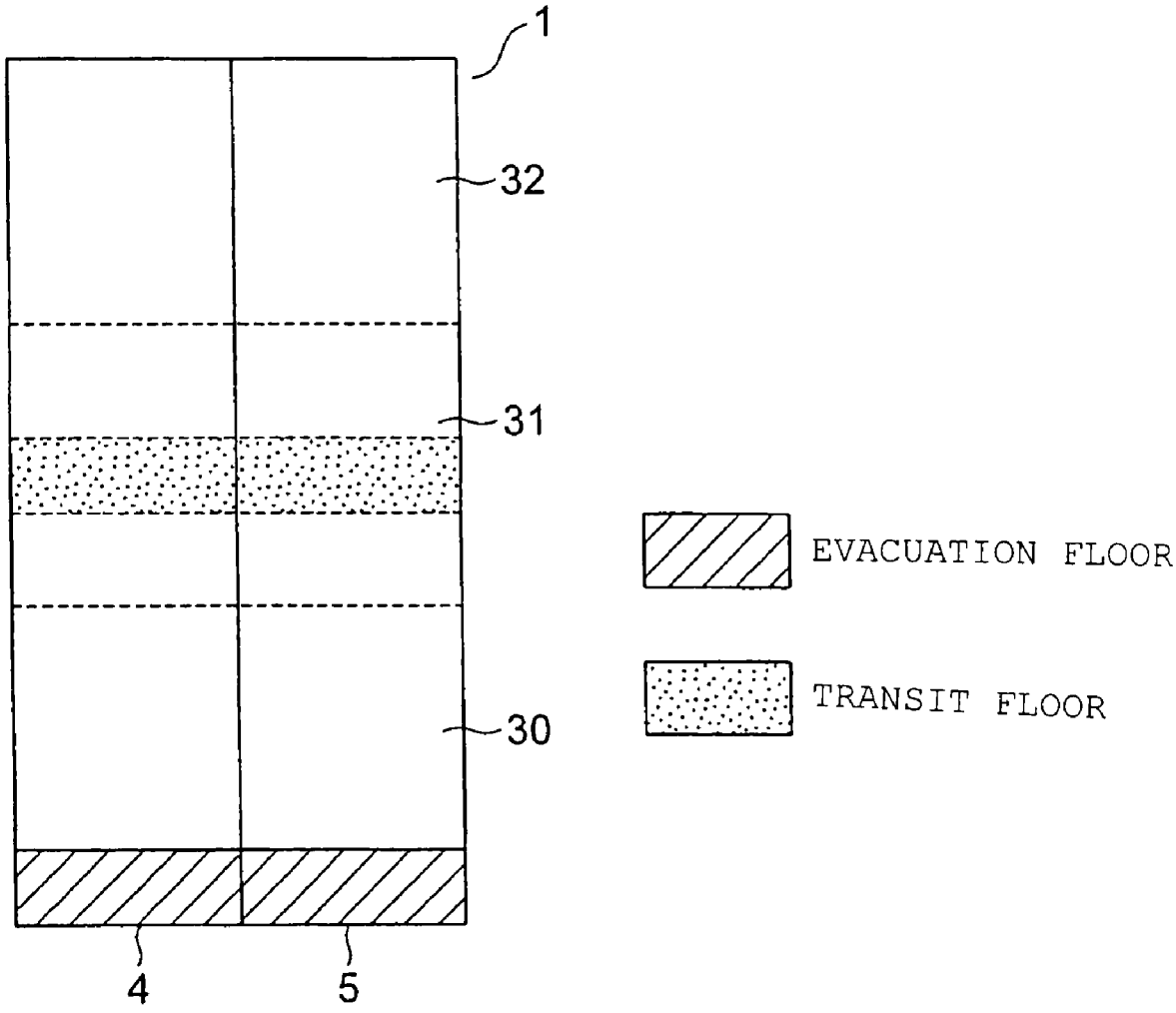
FIG. 4 is a schematic diagram showing a state in which the building of FIG. 3 is separated into a plurality of evacuation zones.
Figure 5:
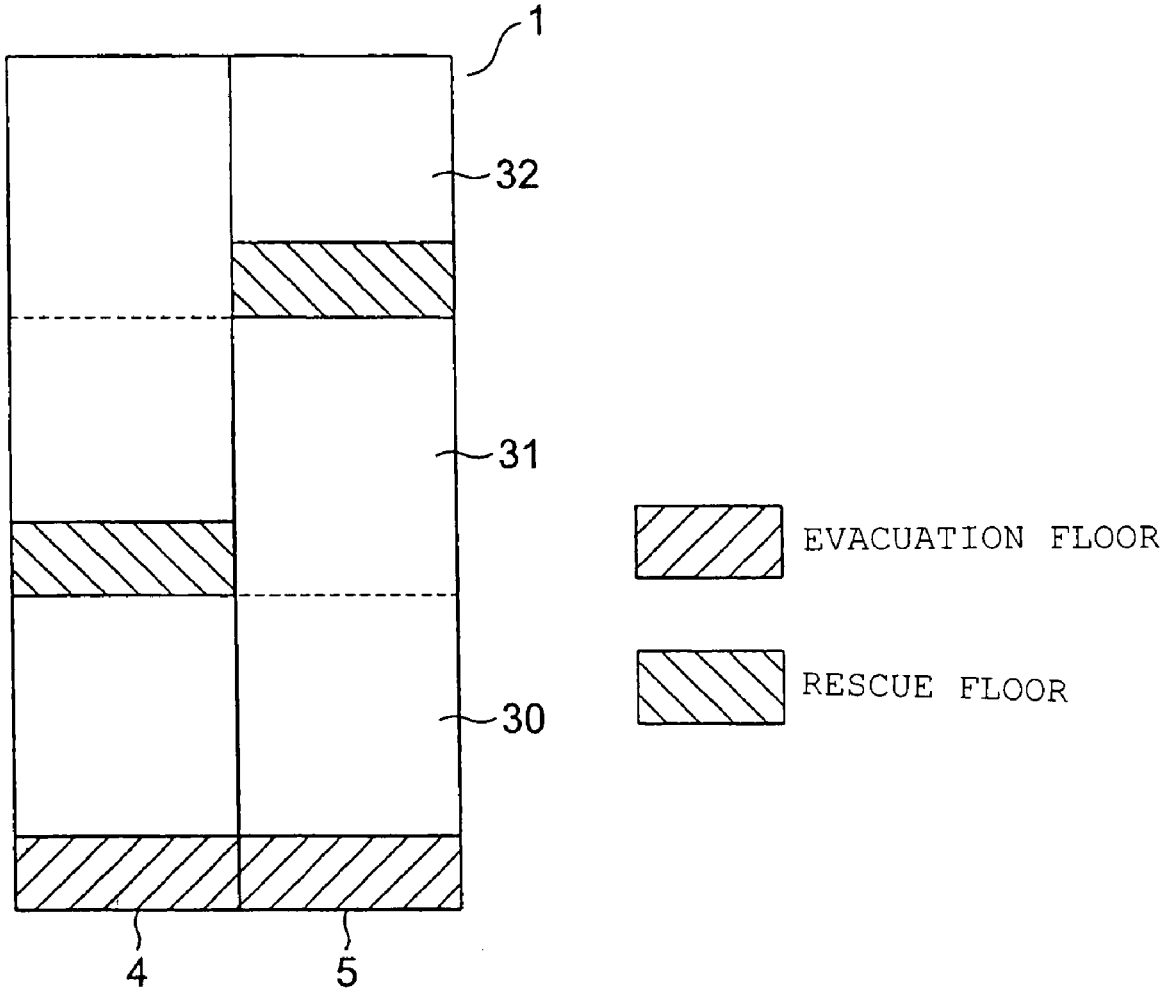
FIG. 5 is a schematic diagram showing a state in which the rescue floors are set in the building of FIG. 4 by the rescue floor setting portion.

Reference will now be made to FIGS. 3 to 5. FIG. 3 is a schematic diagram showing the building 1 before the rescue floor setting portion 26 of FIG. 1 sets the rescue floors. FIG. 4 is a schematic diagram showing a state in which the building 1 of FIG. 3 is separated into a plurality of evacuation zones. In addition, FIG. 5 is a schematic diagram showing a state in which the rescue floors are set in the building 1 of FIG. 4 by the rescue floor setting portion 26. As shown in FIGS. 3 and 4, the building 1 provided with the two service zones 2 and 3 is separated into three evacuation zones (FIGS. 3 and 4). The lowest floors in the two evacuation zones other than the lowest evacuation zone are set as the rescue floors (predetermined service floors) (FIG. 5). Accordingly, the evacuation floor and the rescue floors are different from one another. Those stranded in the evacuation zones of the building move to the rescue floors located below or the evacuation floor by the stairs.

In this example, the evacuation zones are a first evacuation zone 30 including the second floor and the third floor, a second evacuation zone 31 including the fourth to sixth floors, and a third evacuation zone 32 including the seventh to ninth floors. Accordingly, the rescue floors (predetermined service floors) are the fourth floor and the seventh floor.

The evacuation operation command portion 27 outputs a command for evacuation operation to each of the group supervisory devices 6, based on information from the rescue floor setting portion 26. Upon receiving the command for evacuation operation from the evacuation operation command portion 27, each of the group supervisory devices 6 supervises and controls corresponding ones of the elevator machines such that evacuation operation is performed. During evacuation operation, each of the cars is directly operated between a corresponding one of the rescue floors and the evacuation floor. That is, during evacuation operation, each of the cars is stopped only at a corresponding one of the rescue floors and the evacuation floor, and moves past all the floors located between the corresponding one of the rescue floors and the evacuation floor.

The evacuation operation performability determining portion 28 determines whether or not evacuation operation can be performed as to each of the elevators 4 and 5, based on the information from the disaster prevention supervisory device 14 and the information from the rescue floor setting portion 26. That is, the evacuation operation performability determining portion 28 determines whether or not evacuation operation can be performed between each of the rescue floors and the evacuation floor (whether or not those stranded in the building can be conveyed from each of the rescue floors to the evacuation floor), based on a positional relationship between that rescue floor and the fire occurrence floor. More specifically, the evacuation operation performability determining portion 28 determines that evacuation operation cannot be performed (makes a negative determination on the performability of evacuation operation) between each of the rescue floors and the evacuation floor when that rescue floor coincides with a floor in the building 1 where the fire is estimated to spread (hereinafter referred to as "the fire spread estimated floor"), that is, the fire occurrence floor, the floor located directly above the fire occurrence floor, or the like, and determines that evacuation operation can be performed (makes an affirmative determination on the performability of evacuation operation) between that rescue floor and the evacuation floor when that rescue floor does not coincide therewith. The evacuation operation performability determining portion 28 determines whether or not evacuation operation can be performed, individually as to the rescue floors.

The evacuation guidance device control portion 29 performs control for reporting the evacuation information to those stranded in the building 1, as to the evacuation guidance device 21.

The evacuation guidance device control portion 29 performs control for preventing those stranded in the building 1 from further accessing the elevator region 8 of that one of the rescue floors at which those stranded in the building cannot be accepted, as to the access guidance device 22, based on information from the evacuation operation performability determining portion 28 and the information from the rescue floor crowdedness detecting device 16. That is, the evacuation guidance device control portion 29 causes the access guidance device 22 to report the accessibility information stating that those stranded in the building can access the elevator region 8 of each of the rescue floors from the stair region 9 when the evacuation operation performability determining portion 28 determines that evacuation operation from that rescue floor can be performed and the rescue floor crowdedness detecting device 16 detects that the elevator region 8 of that rescue floor is uncrowded, and causes the access guidance device 22 to report the accessibility information stating that those stranded in the building cannot access the elevator region 8 of that rescue floor from the stair region 9 at least when a negative determination on the performability of evacuation operation from that rescue floor is made or when the crowdedness of the elevator region 8 of that rescue floor is detected.

The evacuation guidance device control portion 29 performs control for preventing those stranded in the building 1 who move down the evacuation stairs 7 toward each of the rescue floors and those stranded in the building 1 who escape from the elevator region 8 of that rescue floor to the stair region 9 from bumping against each other to stagnate (stagnation avoidance control), as to the stair guidance device 23 and the escape guidance device 24, based on the information from the evacuation operation performability determining portion 28, the information from the rescue floor crowdedness detecting device 16, and the information from the stair crowdedness detecting device 20.

Stagnation of those stranded in the building may take place in the vicinity of the evacuation doorway 10 at each of the rescue floors when both the elevator region 8 and the stair region 9 are crowded at that rescue floor, and the evacuation operation performability determining portion 28 determines that a changeover has been made from a state in which evacuation operation from that rescue floor can be performed (those stranded in the building can be conveyed from that rescue floor to the evacuation floor) to a state in which evacuation operation therefrom cannot be performed. On the other hand, during normal evacuation, namely, when at least one of the elevator region 8 and the stair region 9 is uncrowded at each of the rescue floors or when evacuation operation from each of the rescue floors continues to be performable, those stranded in the building are unlikely to stagnate even if those stranded in the building 1 who move down the evacuation stairs 7 toward that rescue floor and those stranded in the building 1 who escape from the elevator region 8 of that rescue floor to the stair region 9 join together.

The number of those stranded in the building 1 who are in the elevator region 8 of each of the rescue floors is limited. It is therefore effective to let those stranded in the building 1 who are in the elevator region 8 escape to the stair region 9 in preference to those stranded in the building 1 who move down the evacuation stairs 7.

In this example, therefore, when stagnation of those stranded in the building may take place, the stair guidance device 23 and the escape guidance device 24 are controlled such that only those stranded in the building who move down the evacuation stairs 7 toward each of the rescue floors are stopped from moving while those stranded in the building who escape from the elevator region 8 to the stair region 9 at each of the rescue floors are allowed to move. Stagnation of those stranded in the building is thereby avoided.

That is, the stair guidance device 23 reports to those stranded in the building the stair mobility information stating that those stranded in the building 1 cannot move by the evacuation stairs 7 when both the elevator region 8 and the stair region 9 are crowded at each of the rescue floors, and the evacuation operation performability determining portion 28 determines that a changeover has been made from a state in which evacuation operation from that rescue floor can be performed (those stranded in the building can be conveyed from that rescue floor to the evacuation floor) to a state in which evacuation operation therefrom cannot be performed, and reports to those stranded in the building the stair mobility information stating that those stranded in the building can move by the evacuation stairs 7 at least when at least one of the elevator region 8 and the stair region 9 is uncrowded or when a determination on the performability of evacuation operation from that rescue floor remains unchanged.

Regardless of whether or not each of the elevator region 8 and the stair region 9 is crowded, the escape guidance device 24 stops reporting the escapability information to those stranded in the building 1 when the evacuation operation performability determining portion 28 determines that evacuation operation can be performed, and reports to those stranded in the building the escapability information stating that those stranded in the building can escape from the elevator region 8 of each of the rescue floors to the stair region 9 when the evacuation operation performability determining portion 28 determines that evacuation operation cannot be performed. That is, in this example, those stranded in the building can always escape from the elevator region 8 of each of the rescue floors to the stair region 9.

The disaster prevention supervisory device 14 and the emergency control device 15 are installed in a monitoring center (not shown) provided in the building 1. A control command from the evacuation guidance device control portion 29 is transmitted to the evacuation guidance device 21 via the disaster prevention supervisory device 14. In addition, the access guidance device 22, the stair guidance device 23, and the escape guidance device 24 are individually controlled by the evacuation guidance device control portion 29.

The disaster prevention supervisory device 14 is provided with a remote display device (not shown) for individually displaying the operations of the access guidance device 22, the stair guidance device 23, and the escape guidance device 24. In this example, the remote display device displays evacuation information, which is reported to those stranded in the building 1 by each of the access guidance device 22, the stair guidance device 23, and the escape guidance device 24, based on information from the evacuation guidance device control portion 29. In the monitoring center, a monitoring staff monitors the evacuation information displayed by the remote display device.

The monitoring center is provided with a remote control device (not shown) for remotely controlling the operations of the access guidance device 22, the stair guidance device 23, and the escape guidance device 24, and a selection switch (not shown) for selecting control by the evacuation guidance device control portion 29 (normal evacuation guidance control) or control by the remote control device (remote evacuation guidance control). That is, the control mode of each of the access guidance device 22, the stair guidance device 23, and the escape guidance device 24 can be changed over between normal evacuation guidance control and remote evacuation guidance control by manipulating the selection switch. The selection of the control mode by the selection switch is made individually as to each of the access guidance device 22, the stair guidance device 23, and the escape guidance device 24.

The access guidance device 22, the stair guidance device 23, and the escape guidance device 24 have indicators 33 for indicating evacuation information and speakers (sound emitting devices) 34 for announcing evacuation information to those stranded in the building (FIG. 2). In response to the control of each of the access guidance device 22, the stair guidance device 23, and the escape guidance device 24 by the evacuation guidance device control portion 29, evacuation information is indicated by a corresponding one of the indicators 33, and a sound representing the evacuation information is emitted from a corresponding one of the speakers 34.

Figure 6:
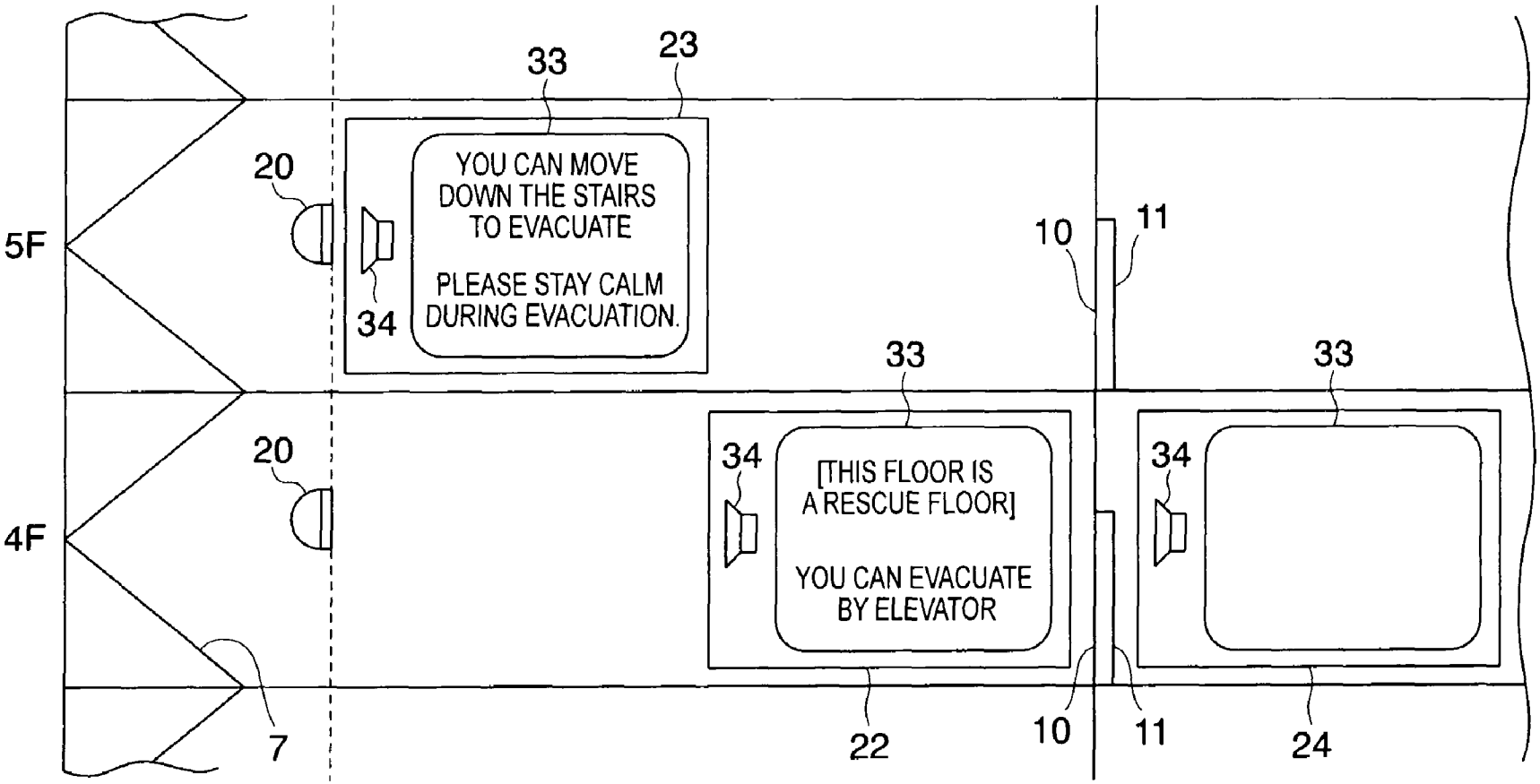
FIG. 6 is an explanatory diagram showing an example of the contents of evacuation information indicated by the indicator of each of the access guidance device, the stair guidance device, and the escape guidance device of FIG. 2.
Figure 7:
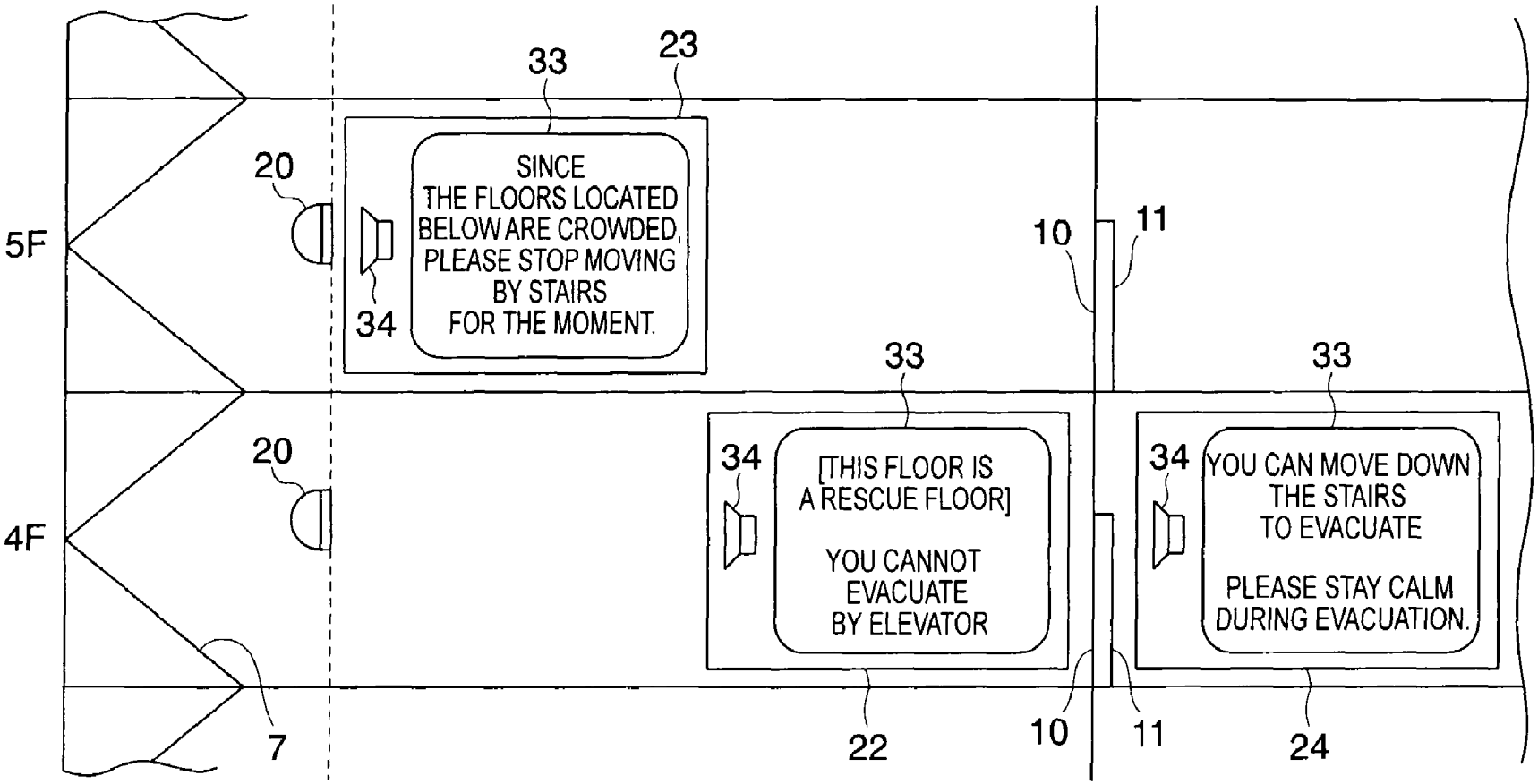
FIG. 7 is an explanatory diagram showing another example of the contents of evacuation information indicated by the indicator of each of the access guidance device, the stair guidance device, and the escape guidance device of FIG. 2.

FIG. 6 is an explanatory diagram showing an example of the contents of evacuation information indicated by the indicator 33 of each of the access guidance device 22, the stair guidance device 23, and the escape guidance device 24 of FIG. 2. FIG. 7 is an explanatory diagram showing another example of the contents of evacuation information indicated by the indicator 33 of each of the access guidance device 22, the stair guidance device 23, and the escape guidance device 24 of FIG. 2. FIG. 6 shows the example of the contents of evacuation information at the time when the elevator region 8 of each of the rescue floors is uncrowded, and the evacuation operation performability determining portion 28 determines that evacuation operation from that rescue floor can be performed. FIG. 7 shows the example of the contents of evacuation information at the time when both the elevator region 8 and the stair region 9 are crowded at each of the rescue floors, and the evacuation operation performability determining portion 28 determines that a changeover has been made from a state in which evacuation operation from that rescue floor can be performed to a state in which evacuation operation therefrom cannot be performed.

As shown in FIGS. 6 and 7, when the elevator region 8 of each of the rescue floors is uncrowded and the evacuation operation performability determining portion 28 determines that evacuation operation from that rescue floor can be performed, the indicator 33 of the access guidance device 22 indicates "THIS IS A RESCUE FLOOR. YOU CAN EVACUATE BY ELEVATOR." as accessibility information, and the indicator 33 of the stair guidance device 23, which is located above that rescue floor, indicates "YOU CAN MOVE DOWN THE STAIRS TO EVACUATE. PLEASE STAY CALM DURING EVACUATION." as stair mobility information. At this moment, sounds representing the contents indicated by the indicators 33 are individually emitted from the speakers 34 of the access guidance device 22 and the stair guidance device 23. In addition, the operations of the indicator 33 and the speaker 34 of the escape guidance device 24 are stopped at this moment (FIG. 6).

When both the elevator region 8 and the stair region 9 are crowded at each of the rescue floors and the evacuation operation performability determining portion 28 determines that a changeover has been made from a state in which evacuation operation from that rescue floor can be performed to a state in which evacuation operation therefrom cannot be performed, the indicator 33 of the access guidance device 22 indicates "THIS IS A RESCUE FLOOR. YOU CANNOT EVACUATE BY ELEVATOR." as accessibility information, and the indicator 33 of the stair guidance device 23, which is located above that rescue floor, indicates "SINCE THE FLOORS LOCATED BELOW ARE CROWDED, PLEASE STOP MOVING BY STAIRS FOR THE MOMENT." as stair mobility information. At this moment, the indicator 33 of the escape guidance device 24 indicates "YOU CAN MOVE DOWN THE STAIRS TO EVACUATE. PLEASE STAY CALM DURING EVACUATION." as escapability information. In addition, at this moment, sounds representing the contents indicated by the indicators 33 are individually emitted from the speakers 34 of the access guidance device 22, the stair guidance device 23, and the escape guidance device 24 (FIG. 7).

The respective emergency broadcast devices 13 can acoustically advise those stranded in the entire building 1 to use the evacuation stairs 7 during evacuation and move according to the evacuation information obtained from each evacuation guidance device 21.

The emergency control device 15 is constituted by a computer having a calculation processing portion (CPU), a storage portion (ROM, RAM, and the like), and signal input/output portions. The functions of the communication portion 25, the rescue floor setting portion 26, the evacuation operation command portion 27, the evacuation operation performability determining portion 28, and the evacuation guidance device control portion 29 are realized by the computer constituting the emergency control device 15.

That is, programs for realizing the functions of the communication portion 25, the rescue floor setting portion 26, the evacuation operation command portion 27, the evacuation operation performability determining portion 28, and the evacuation guidance device control portion 29 are stored in the storage portion of the computer. Information on the respective rescue floors and the like is also stored in the storage portion. The calculation processing portion performs calculation processings regarding the function of the emergency control device 15, based on the programs stored in the storage portion.

Figure 8:
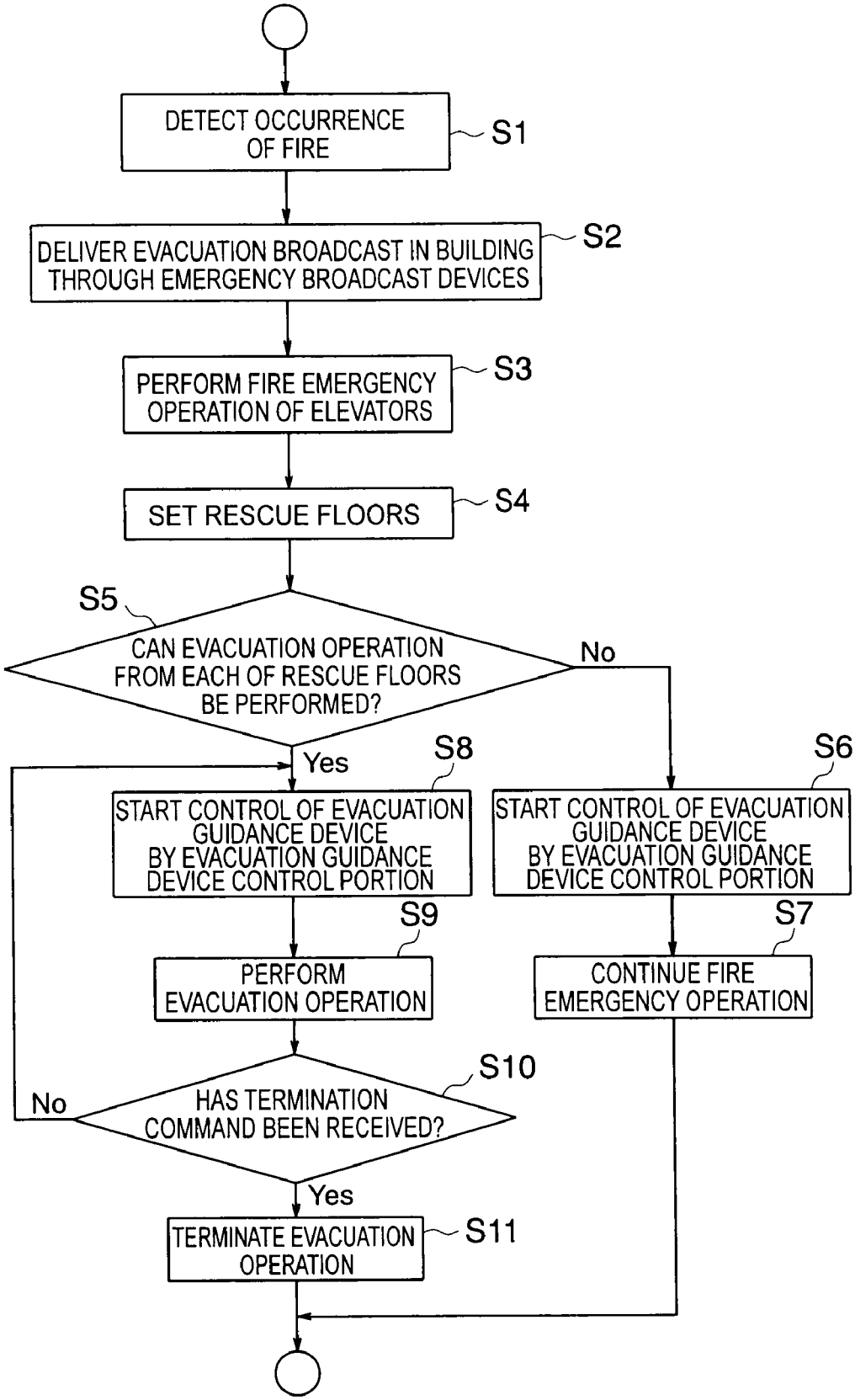
FIG. 8 is a flowchart for explaining the processing operation of the emergency control device of FIG. 1.

Next, an operation will be described. FIG. 8 is a flowchart for explaining the processing operation of the emergency control device 15 of FIG. 1. As shown in FIG. 8, when the occurrence of a fire is detected by the disaster prevention supervisory device 14 (S1), a command for delivering an evacuation broadcast for evacuating those stranded in the building is output from the disaster prevention supervisory device 14 to each of the emergency broadcast devices 13 (S2). As a result, the respective emergency broadcast devices 13 start delivering the broadcast in the building. Owing to the broadcast in the building, those stranded in the building are led to move to the respective floors located below by the evacuation stairs 7. Fire detection information is output from the disaster prevention supervisory device 14 to the emergency control device 15.

After that, upon receiving the fire detection information from the disaster prevention supervisory device 14, the emergency control device 15 performs control such that fire emergency operation for stopping all the cars at the evacuation floor is performed as to each of the elevators 4 and 5 (S3). After that, the rescue floor setting portion 26 sets the rescue floors (the fourth floor and the seventh floor) for the service zones 2 and 3 respectively (S4). After that, the evacuation operation performability determining portion 28 determines whether or not evacuation operation from each of the rescue floors can be performed, based on information from the disaster prevention supervisory device 14 and information from the rescue floor setting portion 26 (S5).

When it is determined that evacuation operation from each of the rescue floors cannot be performed, the evacuation guidance device control portion 29 starts controlling the evacuation guidance device 21 installed at that rescue floor (S6). In this case, the emergency control device 15 performs control such that evacuation operation from that rescue floor is not performed and that the cars continue to be stopped at the evacuation floor through fire emergency operation (S7).

On the other hand, when it is determined that evacuation operation from each of the rescue floors can be performed as well, the evacuation guidance device control portion 29 starts controlling the evacuation guidance device 21 installed at that rescue floor (S8).

After that, evacuation operation from that rescue floor is performed through a command from the evacuation operation command portion 27 (S9). During evacuation operation, each of the cars is moved back and forth between a corresponding one of the rescue floors and the evacuation floor. Thus, those stranded at that rescue floor of the building are conveyed from that rescue floor to the evacuation floor.

After that, the emergency control device 15 determines whether or not the emergency control device 15 has received a termination command (S10). The emergency control device 15 receives the termination command, for example, when a termination button installed in each of the elevators 4 and 5 is manipulated, when an abnormality detecting sensor installed in each of the elevators 4 and 5 is actuated due to the spread of the fire, the inundation resulting from fire fighting, or the like, or when the absence of people getting on the cars at each of the rescue floors is detected by a boarding/disembarkation sensor or the like. That is, the emergency control device 15 receives the termination command when the continuation of evacuation operation becomes difficult or when a condition for completing evacuation operation is fulfilled.

When it is determined that the emergency control device 15 has not received the termination command, the control of the evacuation guidance device 21 by the evacuation guidance device control portion 29 and the performance of evacuation operation from that rescue floor are continued. When it is determined that the emergency control device 15 has received the termination command, evacuation operation of each of the elevators 4 and 5 is terminated (S11).

Figure 9:
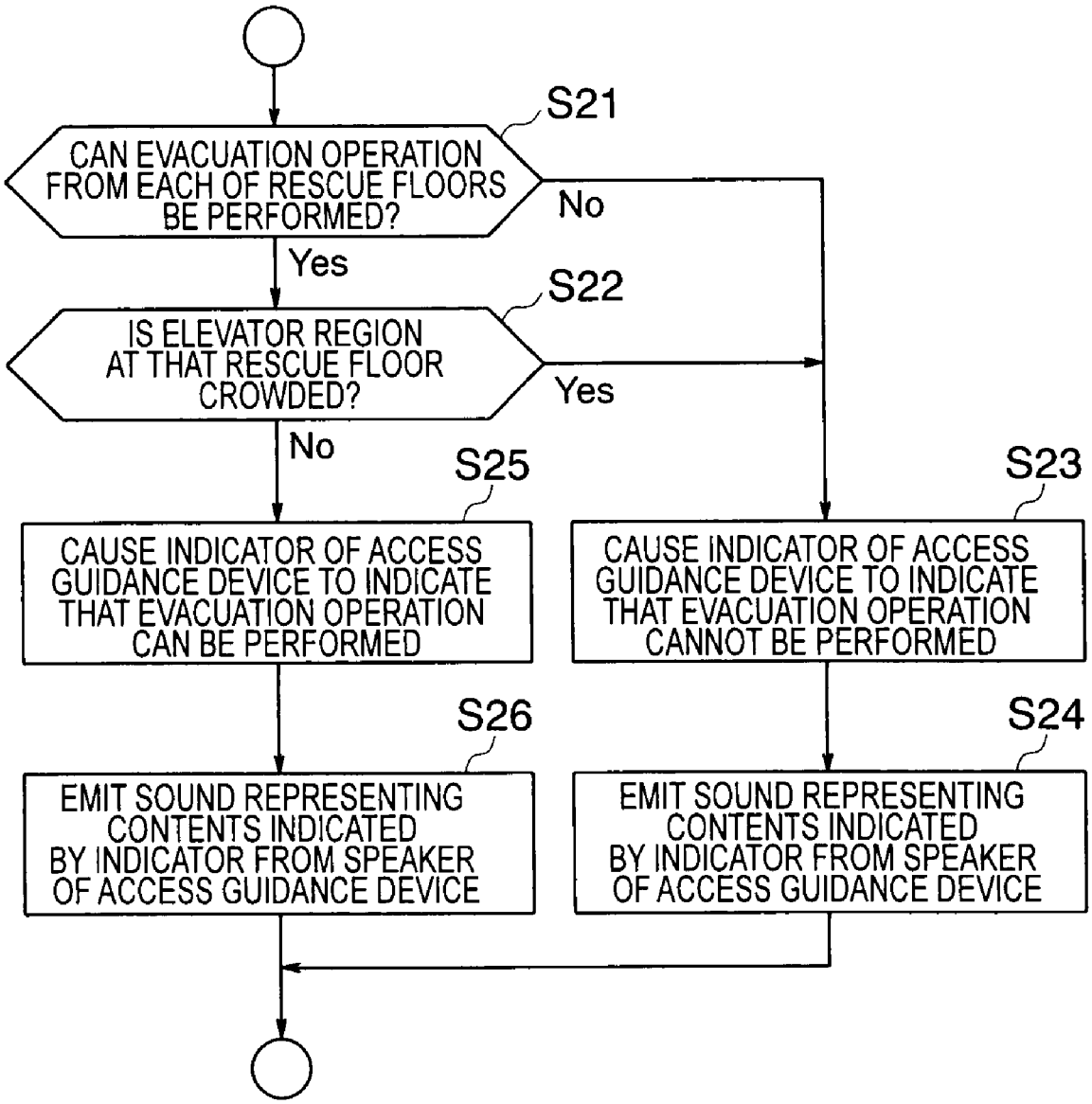
FIG. 9 is a flowchart for explaining the processing operation of the evacuation guidance device control portion in controlling the operation of the access guidance device of FIG. 1.

Next, the control performed by the evacuation guidance device control portion 29 in operating the access guidance device 22 will be described. FIG. 9 is a flowchart for explaining the processing operation of the evacuation guidance device control portion 29 in controlling the operation of the access guidance device 22 of FIG. 1. As shown in FIG. 9, the evacuation guidance device control portion 29 determines whether or not evacuation operation from each of the rescue floors can be performed, based on information from the evacuation operation performability determining portion 28 (S21).

When it is determined that evacuation operation from that rescue floor can be performed, the evacuation guidance device control portion 29 determines whether or not the elevator region 8 of that rescue floor is crowded, based on information from the rescue floor crowdedness detecting device 16 (S22).

When it is determined that evacuation operation from that rescue floor cannot be performed or when it is determined that the elevator region 8 of that rescue floor is crowded, the evacuation guidance device control portion 29 performs control such that the indicator 33 of the access guidance device 22 indicates that the floor in question is a rescue floor and that evacuation operation from the rescue floor cannot be performed (S23). At this moment, a sound representing the contents indicated by the indicator 33 is emitted from the speaker 34 of the access guidance device 22 (S24).

When it is determined that the elevator region 8 of each of the rescue floors is uncrowded after it is determined that evacuation operation from that rescue floor can be performed, the indicator 33 of the access guidance device 22 indicates that the floor in question where evacuation operation from the rescue floor can be performed is the rescue floor and that evacuation operation from the rescue floor can be performed (S25). At this moment, a sound representing the contents indicated by the indicator 33 is emitted from the speaker 34 of the access guidance device 22 (S26). In this manner, the operation of the access guidance device 22 is controlled.

Figure 10:
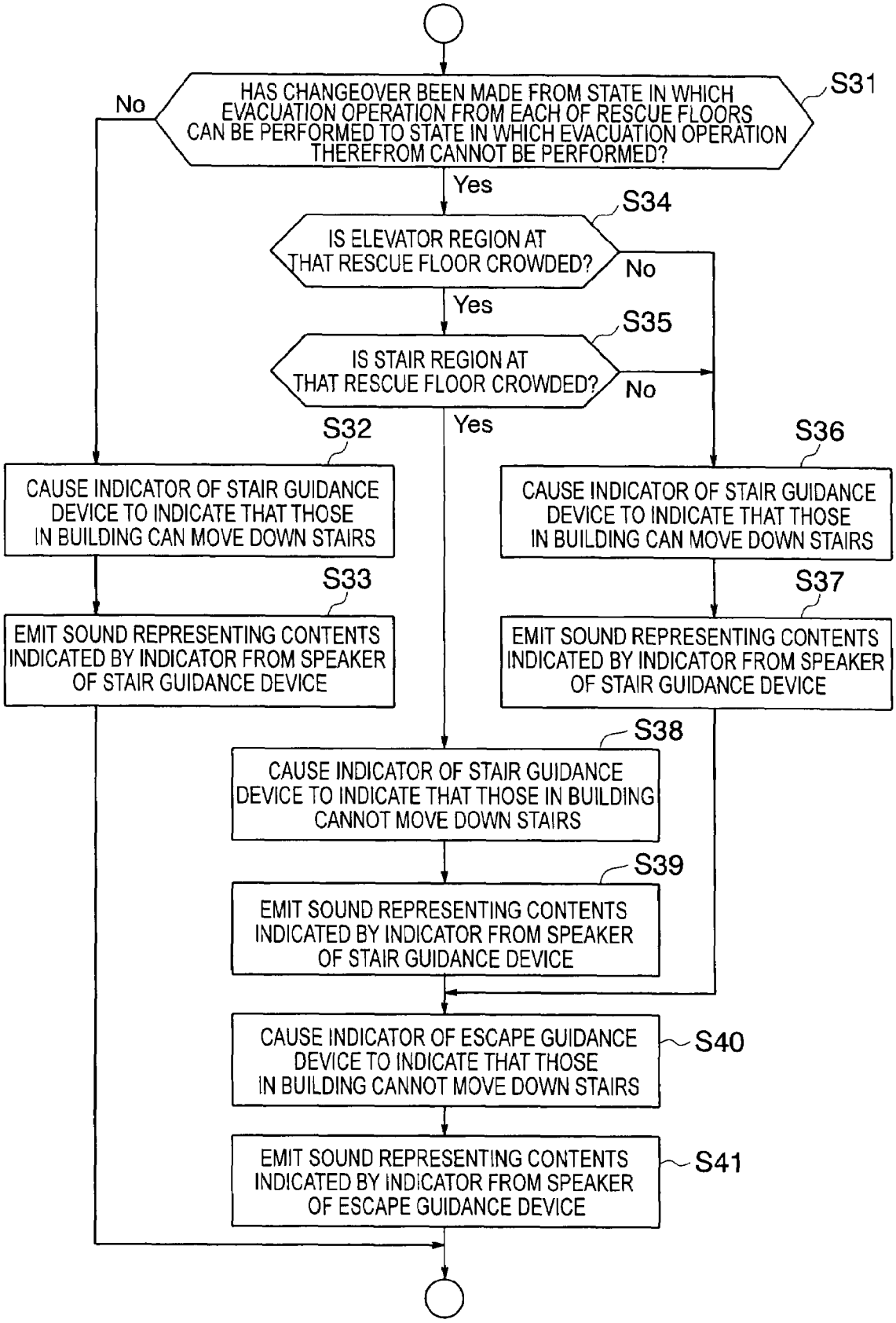
FIG. 10 is a flowchart for explaining the processing operation of the evacuation guidance device control portion in controlling the operations of the stair guidance device of FIG. 1 and the escape guidance device of FIG. 1.

Next, the control performed by the evacuation guidance device control portion 29 in operating the stair guidance device 23 and the escape guidance device 24 will be described. FIG. 10 is a flowchart for explaining the processing operation of the evacuation guidance device control portion 29 in controlling the operations of the stair guidance device 23 of FIG. 1 and the escape guidance device 24 of FIG. 1. As shown in FIG. 10, the evacuation guidance device control portion 29 determines whether or not a changeover has been made from a state in which evacuation operation from each of the rescue floors can be performed to a state in which evacuation operation therefrom cannot be performed, based on information from the evacuation operation performability determining portion 28 (S31). When the state in which evacuation operation therefrom can be performed continues, the evacuation guidance device control portion 29 performs control such that the indicator 33 of the stair guidance device 23 indicates that those stranded in the building can move down the evacuation stairs 7 and that those stranded in the building should move down the evacuation stairs 7 to be evacuated (S32). In this case, the evacuation guidance device control portion 29 performs control to stop the operation of the escape guidance device 24, so the escapability information is not reported to those stranded in the building (S33).

On the other hand, when it is determined that the changeover has been made from the state in which evacuation operation from each of the rescue floors can be performed to the state in which evacuation operation therefrom cannot be performed, the evacuation guidance device control portion 29 determines whether or not the elevator region 8 of that rescue floor is crowded, based on information from the rescue floor crowdedness detecting device 16 (S34). When it is determined that the elevator region 8 of that rescue floor is crowded, the evacuation guidance device control portion 29 determines whether or not the stair region 9 at that rescue floor is crowded (S35).

When the elevator region 8 of that rescue floor is uncrowded or when the stair region 9 at that rescue floor is uncrowded, the evacuation guidance device control portion 29 performs control such that the indicator 33 of the stair guidance device 23 indicates that those stranded in the building can move down the evacuation stairs 7 and that those stranded in the building should use the evacuation stairs 7 to be evacuated (S36). At this moment, a sound representing the contents indicated by the indicator 33 is emitted from the speaker 34 of the stair guidance device 23 (S37).

When it is determined that both the elevator region 8 and the stair region 9 are crowded at that rescue floor, the evacuation guidance device control portion 29 performs control such that the indicator 33 of the stair guidance device 23 indicates that those stranded in the building cannot move down the evacuation stairs 7 and that those stranded in the building should stop moving by the evacuation stairs 7 for the moment (S38). At this moment, a sound representing the contents indicated by the indicator 33 is emitted from the speaker 34 of the stair guidance device 23 (S39).

After that, the evacuation guidance device control portion 29 performs control such that the indicator 33 of the escape guidance device 24 indicates that those stranded in the building can move down the evacuation stairs 7 and that those stranded in the building should use the evacuation stairs 7 to be evacuated (S40). At this moment, a sound representing the contents indicated by the indicator 33 is emitted from the speaker 34 of the escape guidance device 24 (S41). In this manner, the operations of the stair guidance device 23 and the escape guidance device 24 are controlled.

Figure 11:
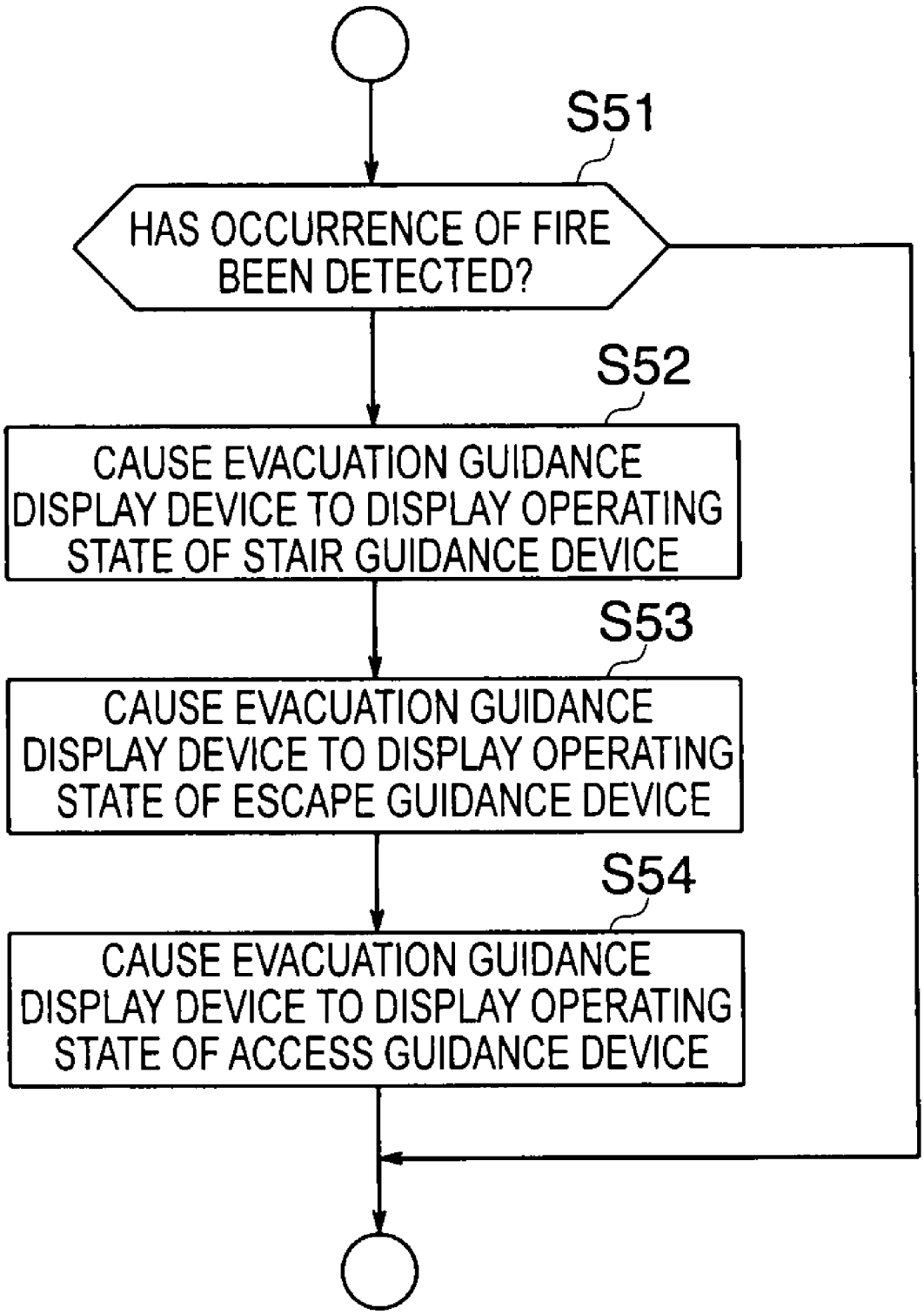
FIG. 11 is a flowchart for explaining the processing operation of the evacuation guidance device control portion in causing the evacuation guidance display device, which is provided in the disaster prevention supervisory device of FIG. 1, to display evacuation information.

Next, the control performed by the evacuation guidance device control portion 29 in causing an evacuation guidance display device to display evacuation information will be described. FIG. 11 is a flowchart for explaining the processing operation of the evacuation guidance device control portion 29 in causing the evacuation guidance display device, which is provided in the disaster prevention supervisory device 14 of FIG. 1, to display evacuation information. As shown in FIG. 11, the evacuation guidance device control portion 29 constantly determines whether or not the disaster prevention supervisory device 14 has detected the occurrence of a fire (S51). When it is determined that the occurrence of a fire has not been detected, the evacuation guidance display device does not display evacuation information.

When it is determined that the occurrence of a fire has been detected, the evacuation guidance device control portion 29 performs control such that the evacuation guidance display device sequentially displays the operating state of the stair guidance device 23 (e.g., the presence or absence of an indication of stair mobility information, the contents of stair mobility information, and the like), the operating state of the escape guidance device 24 (e.g., the presence or absence of an indication of escapability information, the contents of escapability information, and the like), and the operating state of the access guidance device 22 (e.g., the presence or absence of an indication of accessibility information, the contents of accessibility information, and the like) (S52 to S54).

Figure 12:
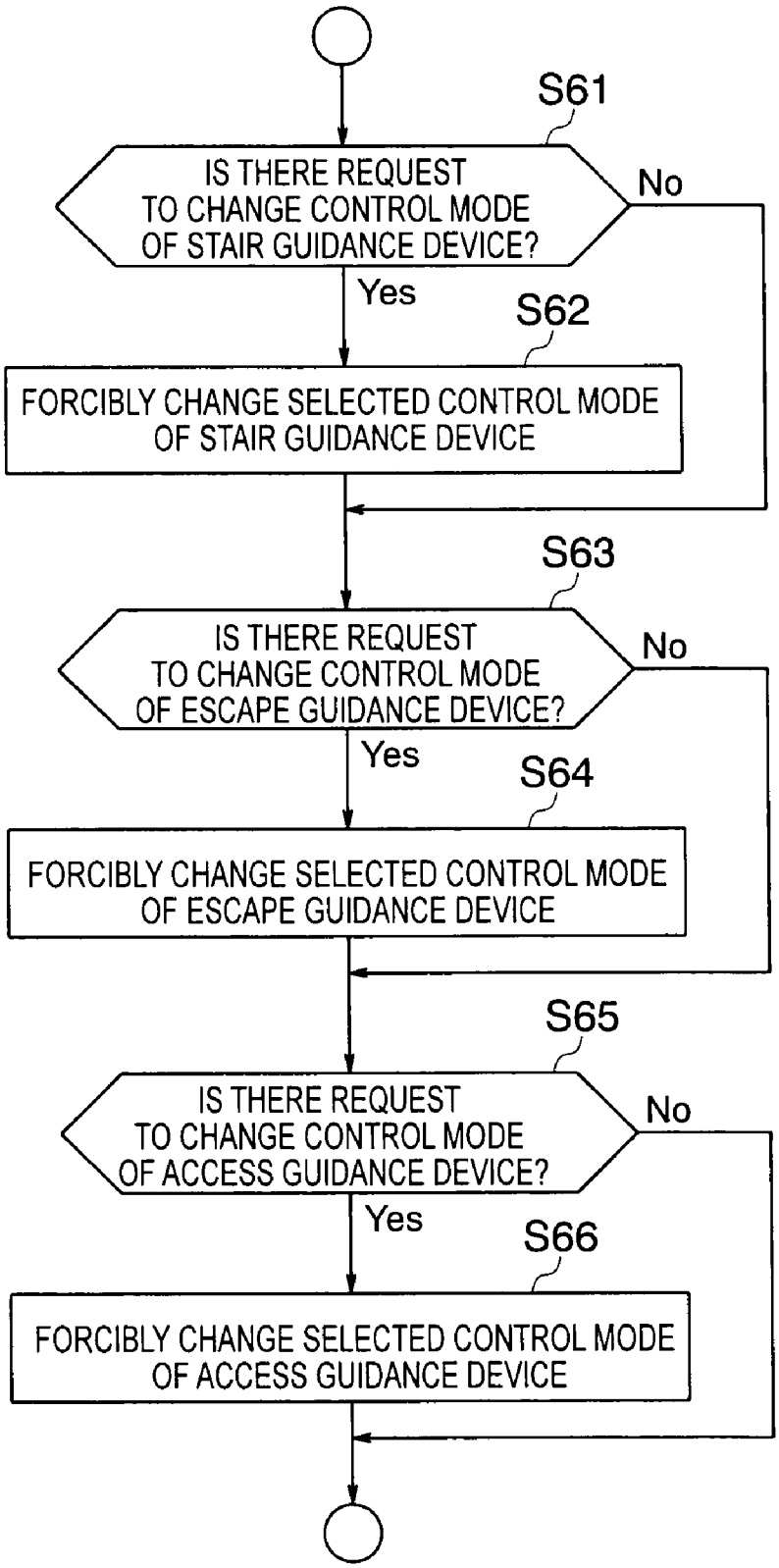
FIG. 12 is a flowchart for explaining the processing operation of the evacuation guidance device control portion in selecting control modes for the access guidance device of FIG. 1, the stair guidance device of FIG. 1, and the escape guidance device of FIG. 1.

Next, the processing operation of the evacuation guidance device control portion 29 in selecting a control mode for the evacuation guidance device 21 through the manipulation of the selection switch will be described. FIG. 12 is a flowchart for explaining the processing operation of the evacuation guidance device control portion 29 in selecting control modes for the access guidance device 22 of FIG. 1, the stair guidance device 23 of FIG. 1, and the escape guidance device 24 of FIG. 1.

As shown in FIG. 12, the evacuation guidance device control portion 29 first determines whether or not a request to make a change from normal evacuation guidance control to remote evacuation guidance control has been received from the selection switch as to the stair guidance device 23 (S61). When the request to make the change in the control mode of the stair guidance device 23 has been received, the evacuation guidance device control portion 29 forcibly changes the control mode for the stair guidance device 23, which is selected by the selection switch, from normal evacuation guidance control to remote evacuation guidance control (S62). When the request to make the change in the control mode of the stair guidance device 23 has not been received, normal evacuation guidance control of the stair guidance device 23 is continued.

After that, the evacuation guidance device control portion 29 determines whether or not a request to make a change from normal evacuation guidance control to remote evacuation guidance control has been received from the selection switch as to the escape guidance device 24 (S63). When the request to make the change in the control mode of the escape guidance device 24 has been received, the evacuation guidance device control portion 29 forcibly changes the control mode for the escape guidance device 24, which is selected by the selection switch, from normal evacuation guidance control to remote evacuation guidance control (S64). When the request to change the control mode of the escape guidance device 24 has not been received, normal evacuation guidance control of the escape guidance device 24 is continued.

After that, the evacuation guidance device control portion 29 determines whether or not a request to make a change from normal evacuation guidance control to remote evacuation guidance control has been received from the selection switch as to the access guidance device 22 (S65). When the request to make the change in the control mode of the access guidance device 22 has been received, the evacuation guidance device control portion 29 forcibly changes the control mode for the access guidance device 22, which is selected by the selection switch, from normal evacuation guidance control to remote evacuation guidance control (S66). When the request to change the control mode of the access guidance device 22 has not been received, normal evacuation guidance control of the access guidance device 22 is continued.

In the evacuation assistance device for the elevators configured as described above, the access guidance device 22 for reporting to those stranded in the building the accessibility information stating whether or not those stranded in the building can access the elevator region 8 of each of the rescue floors from the stair region 9 is installed in the building 1, and the evacuation guidance device control portion 29 controls the access guidance device 22 based on a result of a determination as to whether or not those stranded in the building can be conveyed from each of the rescue floors to the evacuation floor and a result of detection of the crowdedness or uncrowdedness of the elevator region 8 of that rescue floor. Therefore, when evacuation operation from that rescue floor cannot be performed or when the elevator region 8 of that rescue floor is crowded, those stranded in the building can be prevented from accessing the elevator region 8 of that rescue floor. Thus, those stranded in the building can be prevented from making unnecessary movements, so the loss of evacuation time can be reduced. As a result, the efficiency in evacuating those stranded in the building to the evacuation floor can be enhanced.

The access guidance device 22 is provided in the stair region 9 at each of the rescue floors, so a determination on the accessibility to the elevator region 8 can be made when those stranded in the building who have moved down the evacuation stairs 7 are about to enter the elevator region 8. Accordingly, those stranded in the building can be guided more smoothly.

The stair guidance device 23 for reporting to those stranded in the building the stair mobility information stating whether or not those stranded in the building can move by the evacuation stairs 7, and the escape guidance device 24 for reporting to those stranded in the building the escapability information stating whether or not those stranded in the building can escape from the elevator region 8 of each of the rescue floors to the stair region 9 are installed in the building 1. The evacuation guidance device control portion 29 performs, as to the stair guidance device 23 and the escape guidance device 24, control for preventing those stranded in the building who move down the evacuation stairs 7 toward each of the rescue floors and those stranded in the building who escape from the elevator region 8 of that rescue floor to the stair region 9 from bumping against each other to stagnate, based on a result of a determination on the conveyability of those stranded in the building from that rescue floor to the evacuation floor and a result of detection of the crowdedness or uncrowdedness of the elevator region 8 and the stair region 9 at that rescue floor. Therefore, those stranded in the building can be prevented from stagnating therein. Thus, those stranded in the building can be guided more smoothly, so the efficiency in evacuating those stranded in the building to the evacuation floor can be enhanced.

When those stranded in the building may stagnate, the stair guidance device 23 and the escape guidance device 24 are each controlled so as to stop those stranded in the building who move down the evacuation stairs 7 from moving while allowing those stranded in the building to escape from the elevator region 8 of each of the rescue floors. Therefore, those stranded in the building are not forced to wait for a long time in the elevator region 8 of each of the rescue floors. Thus, those stranded in the building can be guided more smoothly, so the efficiency in evacuating those stranded in the building 1 to the evacuation floor can further be enhanced.

The stair guidance device 23 is provided in the stair region 9, and the escape guidance device 24 is provided in the elevator region 8 of each of the rescue floors. Therefore, those stranded in the building can be prevented more reliably from stagnating at each of the rescue floors.

The remote display device for remotely monitoring the operation of the evacuation guidance device 21 is provided in the monitoring center. Therefore, the situation in which those stranded in the building 1 are guided in the building 1 can be grasped easily from a distance.

The control mode for the evacuation guidance device 21 can be changed over between normal evacuation guidance control and remote evacuation guidance control. Therefore, the evacuation guidance device 21 can be changed over to remote control even when, for example, the fire spread situation in the building 1 has changed. As a result, the change in the situation in the building 1 can be coped with swiftly.

In the foregoing example, the crowdedness or uncrowdedness of each of the elevator region 8 and the stair region 9 is detected by subjecting the information from the camera to the image processing. However, the crowdedness or uncrowdedness of each of the elevator region 8 and the stair region 9 may be detected based on, for example, information from a detector using electromagnetic waves such as infrared rays or the like.

In the foregoing example, the three strander detector detectors 17 to 19 are provided in the elevator region 8. However, a single strander detector, two strander detector detectors, or four or more strander detector detectors may be provided in the elevator region 8.

In the foregoing example, the single stair crowdedness detecting device 20 is installed at each of the floors. However, two or more stair crowdedness detecting devices 20 may be installed at each of the floors.

In the foregoing example, the stair crowdedness detecting device 20 is installed at each of the rescue floors and the floors located thereabove. However, it is sufficient to install the stair crowdedness detecting device 20 at least at each of the rescue floors.

In the foregoing example, the threshold to be compared with the occupancy ratios of those stranded in the building in the rescue floor detection ranges is a fixed value. However, this threshold may be variable. That is, the detection level in detecting the crowdedness of the elevator region 8 may be variable in the evacuation guidance device control portion 29.

In the foregoing example, the threshold to be compared with the occupancy ratio of those stranded in the building in the stair detection range is a fixed value. However, this threshold may be variable. That is, the detection level in detecting the crowdedness of the stair region 9 may be variable in the evacuation guidance device control portion 29.

In the foregoing example, the single access guidance device 22 and the single escape guidance device 24 are installed at each of the rescue floors. However, two or more access guidance devices 22 and two or more escape guidance devices 24 may be installed at each of the rescue floors. Further, two or more stair guidance devices 23 may be installed at each of the floors.

In the foregoing example, the control command from the evacuation guidance device control portion 29 is transmitted to the evacuation guidance device 21 via the disaster prevention supervisory device 14. However, the control command from the evacuation guidance device control portion 29 may be directly transmitted to the evacuation guidance device 21.

In the foregoing example, only the stair mobility information is reported from the stair guidance device 23 to those stranded in the building. However, when those stranded in the building are stopped from moving by the evacuation stairs 7 due to the reporting of the stair mobility information, information on a waiting time until those stranded in the building should no longer be stopped from moving by the evacuation stairs 7 as well as the stair mobility information may be reported from the stair guidance device 23 to those stranded in the building. In this case, the evacuation guidance device control portion 29 calculates a space availability degree in the elevator region 8 based on information from the rescue floor crowdedness detecting device 16, and calculates a time required for escape of those stranded in the building from the elevator region 8 as the information on the waiting time based on the obtained space availability degree. The stair guidance device 23 reports the stair mobility information and the information on the waiting time to those stranded in the building based on information from the evacuation guidance device control portion 29. The waiting time shortens as the space availability degree in the elevator region 8 increases. In this manner, those stranded in the building who are left to wait on the evacuation stairs 7 can be restrained from fretting.

When a predetermined time elapses after the moment when the control for stopping those stranded in the building who move down the evacuation stairs 7 toward each of the rescue floors from moving is started by the stair guidance device 23, the control of the stair guidance device 23 performed to stop those stranded in the building from moving may be forcibly canceled regardless of whether or not those stranded in the building have escaped from the elevator region 8 of that rescue floor to the stair region 9. In this manner, those stranded in the building who are left to wait on the evacuation stairs 7 can be restrained from fretting.

In the foregoing example, the single rescue floor is set for each of the service zones 2 and 3. However, a plurality of rescue floors may be set for each of the service zones 2 and 3. The number of the rescue floors set for each of the service zones 2 and 3 may be different from one another. In this case, each of the elevators 4 and 5 performs evacuation operation as to corresponding ones of the rescue floors with the tasks of evacuation operation assigned to the elevator machines respectively. For example, when two rescue floors are set for one service zone, half of the elevator machines perform evacuation operation as to one of the rescue floors, and the other half of the elevator machines perform evacuation operation as to the other rescue floor. In this manner, the respective rescue floors can be restrained from being crowded by those stranded in the building, and the efficiency in conveying those stranded in the building to the evacuation floor can also be further enhanced.

The invention claimed is:

1. An evacuation assistance device for an elevator which, in an event of a fire in a building provided with an elevator whose service floors are defined as each of a plurality of floors included in a service zone and evacuation stairs used to move upstairs and downstairs among the floors, sets a predetermined one of the service floors as a rescue floor and supervises an operation of the elevator so as to convey those stranded in the building from the rescue floor to an evacuation floor, wherein the floors are each separated into an elevator region in which the elevator is provided and a stair region in which the evacuation stairs are provided, the evacuation assistance device comprising:

a rescue floor crowdedness detecting device for detecting crowdedness or uncrowdedness of the elevator region at the rescue floor;

an evacuation guidance device installed in the building to report to those stranded in the building accessibility information representing accessibility of those stranded in the building to the elevator region at the rescue floor from the stair region when the rescue floor crowdedness detecting device detects that the elevator region of the rescue floor is uncrowded; and an emergency control device having an evacuation operation performability determining portion for determining whether or not those stranded in the building can be conveyed from the rescue floor to the evacuation floor and an evacuation guidance device control portion for controlling the evacuation guidance device based on information from the evacuation operation performability determining portion and information from the rescue floor crowdedness detecting device.

2. An evacuation assistance device for an elevator according to claim 1, wherein:

the evacuation guidance device has an access guidance device provided in the stair region at the rescue floor; and the accessibility information is reported to those stranded in the building by the access guidance device.

3. An evacuation assistance device for an elevator which, in an event of a fire in a building provided with an elevator whose service floors are defined as each of a plurality of floors included in a service zone and evacuation stairs used to move upstairs and downstairs among the floors, sets a predetermined one of the service floors as a rescue floor and supervises an operation of the elevator so as to convey those stranded in the building from the rescue floor to an evacuation floor, wherein the floors are each separated into an elevator region in which the elevator is provided and a stair region in which the evacuation stairs are provided, the evacuation assistance device comprising:

a rescue floor crowdedness detecting device for detecting crowdedness or uncrowdedness of the elevator region at the rescue floor;

a stair crowdedness detecting device for detecting crowdedness or uncrowdedness of the stair region;

an evacuation guidance device installed in the building to report to those stranded in the building stair mobility information representing whether or not those stranded in the building can move by the evacuation stairs and escapability information representing whether or not those stranded in the building can escape from the elevator region at the rescue floor to the stair region; and an emergency control device having an evacuation operation performability determining portion for determining whether or not those stranded in the building can be conveyed from the rescue floor to the evacuation floor and an evacuation guidance device control portion for performing control of the evacuation guidance device so as to prevent those stranded in the building who move down the evacuation stairs toward the rescue floor and those stranded in the building who escape from the elevator region at the rescue floor to the stair region from bumping against each other to stagnate, based on information from the evacuation operation performability determining portion, information from the rescue floor crowdedness detecting device, and information from the stair crowdedness detecting device.

4. An evacuation assistance device for an elevator according to claim 3, wherein the evacuation guidance device control portion performs control of the evacuation guidance device so as to stop those stranded in the building who move down the evacuation stairs from moving and allow those stranded in the building who escape from the elevator region at the rescue floor to the stair region to move, when both the elevator region and the stair region are crowded at the rescue floor and a changeover is made from a state in which those stranded in the building can be conveyed from the rescue floor to the evacuation floor to a state in which those stranded in the building cannot be conveyed from the rescue floor to the evacuation floor.

5. An evacuation assistance device for an elevator according to claim 3, wherein:

the evacuation guidance device has a stair guidance device provided in the stair region and an escape guidance device provided in the elevator region at the rescue floor; and the stair mobility information is reported to those stranded in the building who move down the evacuation stairs toward the rescue floor by the stair guidance device; and the escapability information is reported to those stranded in the building who escape from the elevator region at the rescue floor to the stair region by the escape guidance device.

6. An evacuation assistance device for an elevator according to claim 3, wherein:

the evacuation guidance device control portion calculates a time required for escape of those stranded in the building from the elevator region as information on a waiting time, based on the information from the rescue floor crowdedness detecting device, when those stranded in the building are stopped from moving by the evacuation stairs due to reporting of the stair mobility information; and the evacuation guidance device reports to those stranded in the building evacuation information with the information on the waiting time included therein.

7. An evacuation assistance device for an elevator according to claim 1 or 3, further comprising a remote display device for monitoring an operation of the evacuation guidance device.

8. An evacuation assistance device for an elevator according to claim 1 or 3, wherein the evacuation guidance device is controlled according to a control mode that can be changed over between normal evacuation guidance control performed by the evacuation guidance device control portion and remote evacuation guidance control performed by a remote control device provided in a monitoring center.

9. The evacuation assistance device according to claim 1, wherein, the information from the evacuation operation performability determining portion indicates whether the rescue floor coincides with one of the plurality of floors where the fire is estimated to have spread, and the information from the rescue floor crowdedness detecting device indicates the crowdedness or the uncrowdedness of the elevator region at the rescue floor.

10. The evacuation assistance device according to claim 3, wherein, the information from the evacuation operation performability determining portion indicates whether the rescue floor coincides with one of the floors of the building where the fire is estimated to have spread, and the information from the rescue floor crowdedness detecting device indicates the crowdedness or the uncrowdedness of the elevator region at the rescue floor.

11. A computer-readable medium including computer-executable instructions, wherein the computer-executable instructions, when executed by an evacuation assistance device, cause the evacuation assistance device to perform a method comprising:

setting a predetermined one of a plurality of service floors as a rescue floor in an event of a fire in a building, the plurality of service floors included in a plurality of floors in the building and included in a service zone serviced by an elevator provided in the building, the plurality of floors of the building each separated into an elevator region including an elevator shaft and a stair region in which evacuation stairs connecting the plurality of floors are provided;

conveying the elevator from the rescue floor to an evacuation floor, in the event of the fire;

detecting a crowdedness or an uncrowdedness of the elevator region at the rescue floor;

detecting a crowdedness or an uncrowdedness of the stair region;

reporting stair mobility information representing the crowdedness or the uncrowdedness of the stair region, and escapability information representing the crowdedness of the elevator region at the rescue floor and the crowdedness of the stair region at the rescue floor; and determining whether the rescue floor coincides with one of the plurality of floors where the fire is estimated to have spread; and reporting the stair mobility information and the escapability information, based on whether the rescue floor coincides with the one of the plurality of floors where the fire is estimated to have spread, the crowdedness or the uncrowdedness of the elevator region at the rescue floor, and the crowdedness or the uncrowdedness of the stair region.

12. The computer-readable medium according to claim 11, the method further comprising:

reporting the stair mobility information representing the crowdedness of the stair region, when both the crowdedness of the elevator region and the crowdedness of the stair region at the rescue floor are detected and the rescue floor coincides with the one of the plurality of floors where the fire is estimated to have spread.

13. The computer-readable medium according to claim 11, the method further comprising:

reporting the stair mobility information in the stair region at one of the plurality of floors above the rescue floor; and reporting the escapability information in the elevator region at the rescue floor.

14. The computer-readable medium according to claim 11, the method further comprising:

calculating a waiting time from the elevator region, based on the crowdedness of the elevator region at the rescue floor, when the stair mobility information represents the crowdedness of the stair region, and reporting the waiting time in the building.

* * * * *